US006938581B2

(12) United States Patent
Neeser et al.

(10) Patent No.: US 6,938,581 B2
(45) Date of Patent: Sep. 6, 2005

(54) SUPPLEMENTAL WATER HEATER TANK AND SYSTEM

(75) Inventors: Timothy A. Neeser, Savage, MN (US); Thomas J. Shaw, Montgomery, MN (US); David A. Wondra, Montgomery, MN (US); Paul A. Drube, Burnsville, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 10/449,979

(22) Filed: May 30, 2003

(65) Prior Publication Data

US 2004/0237908 A1 Dec. 2, 2004

(51) Int. Cl.[7] ..... F24D 3/08

(52) U.S. Cl. ..... 122/20 R; 122/36; 122/18.5; 237/19

(58) Field of Search ..... 122/20 R, 36, 122/13.01, 18.5; 237/19; 392/441

(56) References Cited

U.S. PATENT DOCUMENTS

| | | | | | |
|---|---|---|---|---|---|
| 1,555,338 | A | | 9/1925 | Vaughan | |
| 1,599,323 | A | * | 9/1926 | Frank | 122/37 |
| 1,961,723 | A | | 6/1934 | Wilson | |
| 2,852,462 | A | * | 9/1958 | Andrus | 205/735 |
| 2,969,451 | A | | 1/1961 | Logan | |
| 3,007,470 | A | * | 11/1961 | Heeger | 122/14.22 |
| 4,438,728 | A | | 3/1984 | Fracaro | |
| 4,548,335 | A | | 10/1985 | Remes et al. | |
| 4,625,753 | A | | 12/1986 | Gustafson | |
| 4,676,199 | A | | 6/1987 | Daugirda et al. | |
| 4,680,446 | A | | 7/1987 | Post | |
| 4,681,257 | A | | 7/1987 | Turner | |
| 4,821,682 | A | * | 4/1989 | Waters | 122/20 A |
| 4,869,208 | A | | 9/1989 | Adams | |
| 4,974,551 | A | * | 12/1990 | Nelson | 122/19.2 |
| 5,006,689 | A | * | 4/1991 | Kurachi et al. | 392/450 |
| 5,020,721 | A | * | 6/1991 | Horne | 236/20 R |
| 5,027,749 | A | | 7/1991 | Cifaldi | |
| 5,317,670 | A | * | 5/1994 | Elia | 392/464 |
| 5,769,033 | A | * | 6/1998 | Petty et al. | 122/14.3 |
| 5,809,941 | A | | 9/1998 | Allaire | |
| 5,872,891 | A | | 2/1999 | Son | |
| D459,452 | S | | 6/2002 | Blanco, Jr. | |
| 6,612,268 | B1 | * | 9/2003 | Peteri et al. | 122/19.2 |

FOREIGN PATENT DOCUMENTS

| | | |
|---|---|---|
| DE | 4231243 | 3/1994 |
| GB | 2301658 | 12/1996 |
| WO | WO 00/63623 | 10/2000 |
| WO | WO 01/36878 | 5/2001 |

* cited by examiner

*Primary Examiner*—Gregory Wilson
(74) *Attorney, Agent, or Firm*—DLA Piper Rudnick Gray Cary US LLP

(57) ABSTRACT

A supplemental water heater tank and system features a supplemental tank with an inner vessel surrounded by an outer jacket. The space there between is generally evacuated of air so that the inner vessel is vacuum insulated. The supplemental tank includes water inlet and outlet ports. Water is heated in a water heater and transferred from the upper portion of the water heater tank to the lower portion of the vacuum-insulated supplemental tank through an insulated line and a dip tube that extends between the water inlet port and the bottom portion of the inner vessel. Hot water is withdrawn from the upper portion of the inner vessel of the supplemental tank for use in a home or the like.

20 Claims, 1 Drawing Sheet

SUPPLEMENTAL WATER HEATER TANK AND SYSTEM

BACKGROUND OF THE INVENTION

This invention relates generally to water heaters, and, more particularly, to an insulated supplemental water tank for water heater systems.

A typical hot water heater of the type used in a home basically consists of a water tank, usually insulated with fiberglass or foam insulation, with a heat source positioned in its bottom end. The heat source for the water heater may be a combustible fuel such as natural gas that is burned in a combustion chamber located beneath the tank. Alternatively, the heat source may be an electric heating element positioned in the bottom of the tank.

The water heater is connected to a water source, such as a city water system, so that water is introduced into the tank through its lower portion. As the water is heated by the heat source, it becomes less dense, thereby rising to the top of the tank. Heated water from the top of the water heater tank is drawn off and supplied to use points in the home, such as faucets, shower heads, dishwashers and laundry machines, via the home hot water system.

A disadvantage of such an arrangement, however, is that during periods of high hot water usage, the temperature of the water may be inconsistent as water is drawn off of the top of the water heater tank faster than the heat source may heat it. In extreme cases, all of the hot water may be used so that the water heater must be given time to "catch up" before hot water is once again available. This may be very problematic for large families or homes with a large number of guests.

One solution to such difficulties is to increase the size of the water heater tank and heat source so that the water heater has greater capacity. A disadvantage of this approach, however, is higher energy usage by the larger heat source. In addition, means of access to the room in which the water heater is installed is often limited in size. Homes, buildings and rooms typically have doors of standard width, commonly 32, 36, 48 or 72 inches, and this limits the size, and thus the capacity of water heater that may be installed. Larger capacity water heaters also cost more and thus are expensive to replace.

An alternative approach to providing additional capacity is to multiply the number of water heaters. For example, one could obtain 100 gallon capacity by providing two complete 50 gallon water heaters. This solution is undesirable in that such an approach nearly doubles the cost and maintenance requirements of the system. In addition, duplicative controls are required which further adds to the cost of installation and maintenance.

Systems that provide smaller, supplemental water heaters positioned at the point of use to provide instant hot water are well known in the art. Such systems are illustrated in U.S. Pat. No. 1,555,338 to Vaughan, U.S. Pat. No. 2,969,451 to Logan and U.S. Pat. No. 4,680,446 to Post. Such supplemental water heaters are positioned near faucets, such as under a kitchen sink, or close to other points of use. While the supplemental water heater tanks are insulated, the efficiency of the insulation is not sufficient to keep the water warm without the use of an electric heat source positioned within the supplemental water heater tank. The additional heat source equates to additional energy usage and increased maintenance frequency and cost. Such systems also do not significantly increase the hot water capacity of the system given the limited space provided by the point of use installation.

Accordingly, it is an object of the present invention to provide a water heater system that provides increased hot water capacity.

It is another object of the present invention to provide a water heater system that provides greater consistency in terms of water temperature at points of use.

It is another object of the present invention to provide a water heater system that provides increased capacity without large additional energy usage.

It is still another object of the present invention to provide a water heater system that provides increased capacity with minimal additional complexity.

It is still another object of the present invention to provide a water heater system that provides additional capacity with minimal additional maintenance requirements.

SUMMARY OF THE INVENTION

The present invention is directed to a supplemental water heater tank and system. The supplemental water heater tank includes an outer jacket surrounding an inner vessel so that a space between the inner vessel and the outer jacket is defined. The space is generally evacuated of air so that the inner vessel is vacuum insulated. Water inlet and outlet ports extend between the outer jacket and the inner vessel. A dip tube extends between the water inlet port and a lower portion of the inner vessel. An insulated supplemental tank water inlet line communicates with the dip tube and an upper portion of a water heater. A supplemental tank water outlet line passes through the water outlet port and communicates with the upper portion of the inner vessel of the supplemental tank on one end and a hot water system of a home or the like on the other end.

The water heater receives water and heats it via a heat source in the bottom of the water heater tank. The heated water is transferred from the upper portion of the water heater tank to the lower portion of the supplemental water heater tank through the insulated supplemental tank water inlet line and dip tube. The system provides hot water from the upper portion of the supplemental water heater tank through the supplemental tank water outlet line. Due to the high efficiency of the vacuum insulation, the supplemental water heater tank is capable of preserving the elevated temperature of the heated water for a great length of time. As a result, the hot water capacity of the system is increased and more uniform temperatures are available at the points of use.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
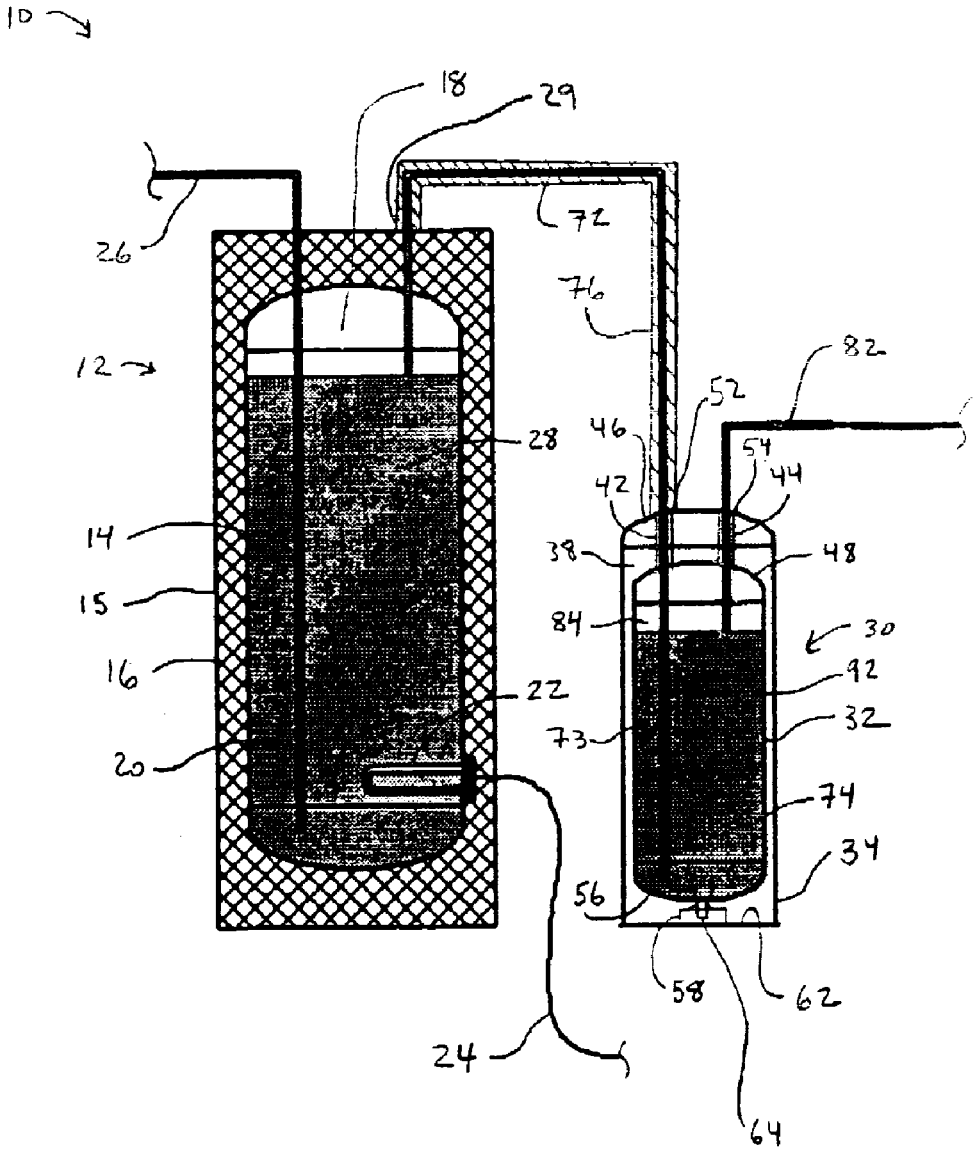
FIG. 1 is a schematic of an embodiment of the supplemental water heater tank and system of the present invention.

An embodiment of the supplemental water heater tank and system of the present invention is indicated in general at 10 in FIG. 1. While the system is described in terms of use in a home, it is to be understood that the invention could be employed in industrial or commercial buildings and structures as well.

As is known in the art, a hot water heater, indicated in general at 12, includes a hot water heater tank 14 surrounded by a jacket 15. Insulation 16 fills the space between the jacket 15 and the tank 14. The jacket 15 is typically constructed of aluminum 15 while the insulation 16 is typically fiberglass or foam insulation. The hot water heater tank 14 defines a hot water heater chamber consisting of an upper portion 18 and a lower portion 20. An electric heating element 22 is positioned within the lower portion 20 of the hot water heater chamber and receives power via electrical line 24. A combustion chamber located beneath the tank 14 that burns a combustible fuel such as natural gas may be substituted for the electric heating element 22. The water heater tank 14 preferably is constructed of steel that is coated to resist corrosion.

A water heater dip tube 26, typically constructed from copper tubing, provides water 28 from a municipal water system or a well or the like to the lower portion 20 of the chamber of the water heater tank. The water 28 is heated by the heating element 22. In prior art systems, the hot water 28 is supplied via hot water outlet 29 to the hot water system of the home where it is dispensed by faucets or showerheads or used by appliances such as dishwashers or laundry machines.

In accordance with the present invention, however, a supplemental water heater tank, indicated in general at 30, is provided. The supplemental tank 30 includes an inner vessel 32 that is surrounded by an outer jacket 34. The space 38 between the inner vessel and outer jacket is evacuated of air so that the inner vessel 32 is vacuum insulated.

The inner vessel 32 is preferably constructed from steel coated with epoxy while the outer jacket 34 is preferably constructed from aluminum. The inner vessel 32 is supported within the outer jacket by neck tubes 42 and 44 that join the top surface 46 of outer jacket 34 to the top surface 48 of inner vessel 32. Neck tubes 42 and 44 define water inlet port 52 and water outlet port 54, respectively. Though not essential, the bottom surface 56 of the inner vessel 32 may be supported by a platform 58 that is secured to the interior surface 62 of the bottom of the outer jacket 34. A centering pin 64 featuring a flange is secured to the bottom surface 56 of the of the inner vessel 32. The centering pin engages a hole in the platform 58 while the flange engages the top surface of the platform.

While the above is the preferred method of constructing the supplemental tank 30, alternative arrangements known in the art for supporting an inner vessel within an outer jacket of a vacuum-insulated tank may be used.

A supplemental tank water inlet line 72 communicates with the upper portion 18 of the chamber of water heater tank 14, extends through the neck 42, and thus through water inlet port 52, of supplemental tank 30 so as to define a dip tube 73 that terminates in the lower portion 74 of the supplemental tank chamber defined by inner vessel 32. The portion of line 72 that is exposed to ambient is provided with insulation 76. Line 72 is preferably constructed from copper tubing and insulation 76 is preferably foam or fiberglass insulation.

A supplemental tank water outlet line 82 communicates with the upper portion 84 of the inner vessel chamber by passing through neck tube 44, and thus water outlet port 54, of the supplemental tank and communicates with the home hot water plumbing system. Line 82 is preferably constructed from copper tubing.

In operation, the water 28 in tank 12 is heated to approximately 125° F. by heating element 22. Due to the water pressure provided by the municipal or other water supply system, the heated water is driven from the upper portion 18 of the water heater tank to the lower portion 74 of the inner vessel chamber of supplemental tank 30 through insulated line 72 and dip tube 73. Heated water is then withdrawn from the top portion 84 of the inner vessel chamber for use in the home via line 82.

The vacuum insulated inner vessel 32 provides for minimal to nearly no heat loss from the heated water 92 stored therein. More specifically, for a 15 gallon inner jacket 32 with the water therein at 125° F., a temperature decrease of only 2° F. over a period of two days is possible when the system sits unused. Due to the superior insulating capabilities of the supplemental tank, no additional heat source is required. This makes the supplemental tank portion of the system virtually maintenance free and very reliable in that there is no heating system to fail.

In addition, since the water provided to the supplemental tank is generally at a uniform temperature, and due to the vacuum insulation of the supplemental tank, the temperature of the water 92 in the supplemental tank is generally uniform. As a result, the supplemental tank and system of the present invention provides more consistent temperature at points of use throughout the home.

The supplemental tank 30 may be provided in a variety of sizes, including sizes small enough to permit it to be installed at a point of use, such as under a sink. The size of the supplemental tank may be chosen so that the system provides greater capacity for a variety of today's hot water demands. As an example, if the supplemental tank 30 has a 15 gallon capacity and the hot water heater 12 has a 50 gallon capacity, the on-demand capacity of the system is increased by approximately 42% (approximately 35 gallons).

In the event that the system is not used for an extended period of time (such as a month or more), the cooled water in the supplemental tank may be used in a manner that does not strictly require hot water, such as to wash a load of laundry or a set of dishes in a laundry machine or dishwasher, respectively.

The relatively small size of the supplemental tank 30 facilitates installation and replacement. In addition, the system permits a smaller water heater to be used for a given hot water capacity. A smaller water heater is easier and less costly to replace. In addition, the smaller water heater requires less energy to operate.

The supplemental tank 30 is easily adapted to a variety of hot water heating systems including, for example, solar water heating systems. All that is necessary is that the system provide hot water to the supplemental tank via line 72.

While the preferred embodiments of the invention have been shown and described, it will be apparent to those skilled in the art that changes and modifications may be made therein without departing from the spirit of the invention, the scope of which is defined by the appended claims.

What is claimed is:

1. A supplemental water heater tank comprising:

a) an inner vessel;

b) an outer jacket generally surrounding the inner vessel so that a space between the inner vessel and the outer jacket is defined, said space generally evacuated of air so that the inner vessel is vacuum insulated; and c) said inner vessel including water inlet and outlet ports, said water inlet port adapted to receive heated water previously stored in a water heater tank and said water outlet port adapted to communicate with a hot water system so that hot water is provided from the supplemental water heater tank to the hot water system for dispensing without further heating or storage in the water heater tank.

2. The supplemental water heater tank of claim 1 further comprising a dip tube extending between the water inlet port and a lower portion of the inner vessel.

3. The supplemental water heater tank of claim 2 further comprising an insulated supplemental tank water inlet line in communication with the dip tube and adapted to communicate with the water heater.

4. The supplemental water heater tank of claim 3 further comprising a supplemental tank water outlet line passing through the water outlet port and communicating with an upper portion of the inner vessel on one end and adapted to communicate with the hot water system on another end.

5. The supplemental water heater tank of claim 1 further comprising a supplemental tank water outlet line passing through the water outlet port and communicating with an upper portion of the inner vessel on one end and adapted to communicate with the hot water system on another end.

6. The supplemental water heater tank of claim 1 wherein the water inlet and outlet ports are defined by neck tubes extending between the inner vessel and the outer jacket.

7. The supplemental water heater tank of claim 6 wherein the neck tubes extend between a top surface of the outer jacket and a top surface of the inner vessel.

8. The supplemental water heater tank of claim 1 further comprising means for supporting a bottom surface of the inner vessel.

9. The supplemental water heater tank of claim 1 wherein said inner vessel is constructed from steel coated with epoxy.

10. The supplemental water heater tank of claim 1 wherein said outer jacket is constructed from aluminum.

11. A water heater system comprising:

a) a water heater having a water heater tank adapted to receive water from a water supply system and including means for heating the water received from the water supply system;

b) a vacuum-insulated supplemental water heater tank;

c) a supplemental tank water inlet line in communication with the water heater tank and the vacuum-insulated supplemental tank so that hot water stored in the water heater tank is transferred to the supplemental water heater tank; and d) a supplemental tank water outlet line in communication with the supplemental water heater tank and adapted to communicate with a hot water system so hot water is provided from the supplemental water heater tank to the hot water system for dispensing without further heating or storage in the water heater tank.

12. The water heater system of claim 11 wherein the supplemental tank water inlet line is insulated.

13. The water heater of claim 11 wherein the supplemental water heater tank includes a dip tube extending from a water inlet port of the supplemental water heater tank to a lower portion of the supplemental water heater tank, said dip tube communicating with the supplemental tank water inlet line.

14. The water heater system of claim 13 wherein the supplemental tank water inlet line extends between an upper portion of the water heater and the dip tube of the supplemental water heater tank.

15. The water heater system of claim 14 wherein the supplemental tank water inlet line is insulated.

16. The water heater system of claim 11 wherein the supplemental tank water outlet line communicates with an upper portion of the supplemental water heater tank.

17. The water heater system of claim 11 wherein said vacuum-insulated supplemental water heater tank includes an inner vessel and an outer jacket with the outer jacket surrounding the inner vessel so that a space between the inner vessel and the outer jacket is defined, said space generally evacuated of air, and neck tubes connecting the inner vessel to the outer jacket so that water inlet and outlet ports are defined, said water inlet port communicating with the supplemental tank water inlet line and said outlet port in communication with the supplemental tank water outlet line.

18. A method for increasing the capacity of a hot water heater having a hot water heater tank comprising the steps of:

a) providing a vacuum-insulated supplemental water heater tank having a water inlet port and a water outlet port;

b) connecting the water inlet port of the supplemental water heater tank to a hot water outlet of the hot water heater tank;

c) connecting the water outlet port of the supplemental water heater tank to a hot water system;

d) supplying water to the hot water heater tank;

e) heating the water supplied to the hot water heater tank;

f) storing the heated water in the hot water heater tank;

g) transferring the heated and stored water from the hot water heater tank to the supplemental water heater tank;

h) storing the heated water in the supplemental water heater tank; and i) providing the heated water stored in the supplemental water heater tank to the hot water system.

19. The method of claim 18 wherein step f) includes transferring the heated water from an upper portion of the water heater to a lower portion of the supplemental water heater tank.

20. The method of claim 18 wherein step h) includes providing the heated water from an upper portion of the supplemental water heater tank.

* * * * *